US005782215A

United States Patent [19]

Engelmann

[11] Patent Number: 5,782,215

[45] Date of Patent: Jul. 21, 1998

[54] INTAKE/EXHAUST VALVE

[76] Inventor: Mark M. Engelmann, 730 Madison Ave., Council Bluffs, Iowa 51503

[21] Appl. No.: 874,310

[22] Filed: Jun. 13, 1997

[51] Int. Cl.[6] ..... F01L 1/28

[52] U.S. Cl. ..... 123/79 C

[58] Field of Search ..... 123/79 C, 188.2

[56] References Cited

U.S. PATENT DOCUMENTS

| | | | |
|---|---|---|---|
| D. 259,935 | 7/1981 | Lovret | D15/5 |
| 1,998,601 | 4/1935 | Zahodiakin | 123/79 C |
| 2,979,046 | 4/1961 | Buchi | 123/79 C |
| 3,060,916 | 10/1962 | Buchi | 123/79 C |
| 3,881,459 | 5/1975 | Gaetcke . | |
| 4,094,277 | 6/1978 | Goto et al. . | |
| 4,362,134 | 12/1982 | Worthen . | |
| 4,844,023 | 7/1989 | Konno et al. | 123/90.16 |
| 4,901,683 | 2/1990 | Huff | 123/79 C |
| 4,942,850 | 7/1990 | Hernandez | 123/79 C |
| 4,957,073 | 9/1990 | Bergeron | 123/79 C |
| 5,005,538 | 4/1991 | Bergeron | 123/79 R |
| 5,085,179 | 2/1992 | Faulkner | 123/70 R |
| 5,168,843 | 12/1992 | Franks . | |
| 5,331,930 | 7/1994 | McWhorter | 123/79 R |
| 5,357,914 | 10/1994 | Huff | 123/79 C |
| 5,415,137 | 5/1995 | Paul | 123/90.16 |

FOREIGN PATENT DOCUMENTS

| | | | |
|---|---|---|---|
| 4030698 | 4/1972 | Germany | 123/79 C |
| 1263887 | 10/1986 | U.S.S.R. | 123/79 C |

*Primary Examiner*—David A. Okonsky

*Attorney, Agent, or Firm*—Zarley, McKee, Thomte, Voorhees & Sease; Mark D. Frederiksen

[57] ABSTRACT

A valve assembly includes a block with a chamber formed therein and a port for accessing the chamber. A fluid inlet passage and a fluid exhaust passage are formed through the block and communicate with the port. A main valve includes a head which is reciprocated into and out of engagement with a lower valve seat formed on a portion of the port. An auxiliary valve includes a head which is reciprocated through the port between a first position below the port and a second position above the port. A hollow cylindrical valve includes a central passage therethrough for fluid flow, and is disposed for reciprocating movement into and out of engagement with an upper valve seat formed on a portion of the port, the cylindrical valve closing the inlet passage when moved to the engaged position. The cylindrical valve passage is in communication with the exhaust passage throughout its movement. Apparatus is provided for sequentially moving each of the main valve, auxiliary valve, and cylindrical valve to sequentially introduce air from the inlet passage through the port and into the chamber, close the port from all fluid flow, and exhaust fluid from the chamber through the port and through the exhaust passage.

17 Claims, 4 Drawing Sheets

INTAKE/EXHAUST VALVE

TECHNICAL FIELD

The present invention relates generally to reciprocating valve mechanisms, and more particularly to an improved valve for both intake and exhaust in an internal combustion engine.

BACKGROUND OF THE INVENTION

In conventional internal combustion engines, the valves which control the flow of air to and from the combustion chamber are one piece, with one spring retainer, and various spring controlled arrangements. The efficiency of such a valve arrangement is a major factor in the performance of an engine, and therefore efforts have been made to maximize the air flow of these valves.

In addition, the atomization of fuel is a major factor in the performance of the engine. Thus, efforts have been made to increase flow of valve assemblies, as well as increasing the atomization of fuel in the valve assemblies, to thereby increase the power of the engine.

One method which has been used in the prior art in an attempt to increase the flow volume to and from the combustion chamber is in the use of multiple valves operating side by side, but independent of one another, so that there are two intake and two exhaust valves. While the increase in air flow is obvious, there are also major disadvantages to this arrangement. First, the cost of manufacture is increased. Second, since the number of valves is increased, the number of parts needed to operate the valve is also increased. This also means more rocker arms, push rods and lifters. Another disadvantage is the cost of maintaining and servicing such arrangements, since they can be much greater than conventional arrangements.

SUMMARY OF THE INVENTION

It is therefore a general object of the present invention to provide an improved valve for charging a chamber and exhausting a chamber with a single port.

Yet another object is to provide a valve assembly which requires less work on both the intake and exhaust strokes.

Still another object of the present invention is to provide a valve assembly which increases air flow and "swirling" of the air within the chamber.

These and other objects of the present invention will be apparent to those skilled in the art.

The valve assembly of the present invention includes a block with a chamber formed therein and a port for accessing the chamber. A fluid inlet passage and a fluid exhaust passage are formed through the block and communicate with the port. A main valve includes a head which is reciprocated into and out of engagement with a lower valve seat formed on a portion of the port. An auxiliary valve includes a head which is reciprocated through the port between a first position below the port and a second position above the port. A hollow cylindrical valve includes a central passage therethrough for fluid flow, and is disposed for reciprocating movement into and out of engagement with an upper valve seat formed on a portion of the port, the cylindrical valve closing the inlet passage when moved to the engaged position. The cylindrical valve passage is in communication with the exhaust passage throughout its movement. Apparatus is provided for sequentially moving each of the main valve, auxiliary valve, and cylindrical valve to sequentially introduce air from the inlet passage through the port and into the chamber, close the port from all fluid flow, and exhaust fluid from the chamber through the port and through the exhaust passage.

DESCRIPTION OF THE PREFERRED EMBODIMENT

Figure 1:
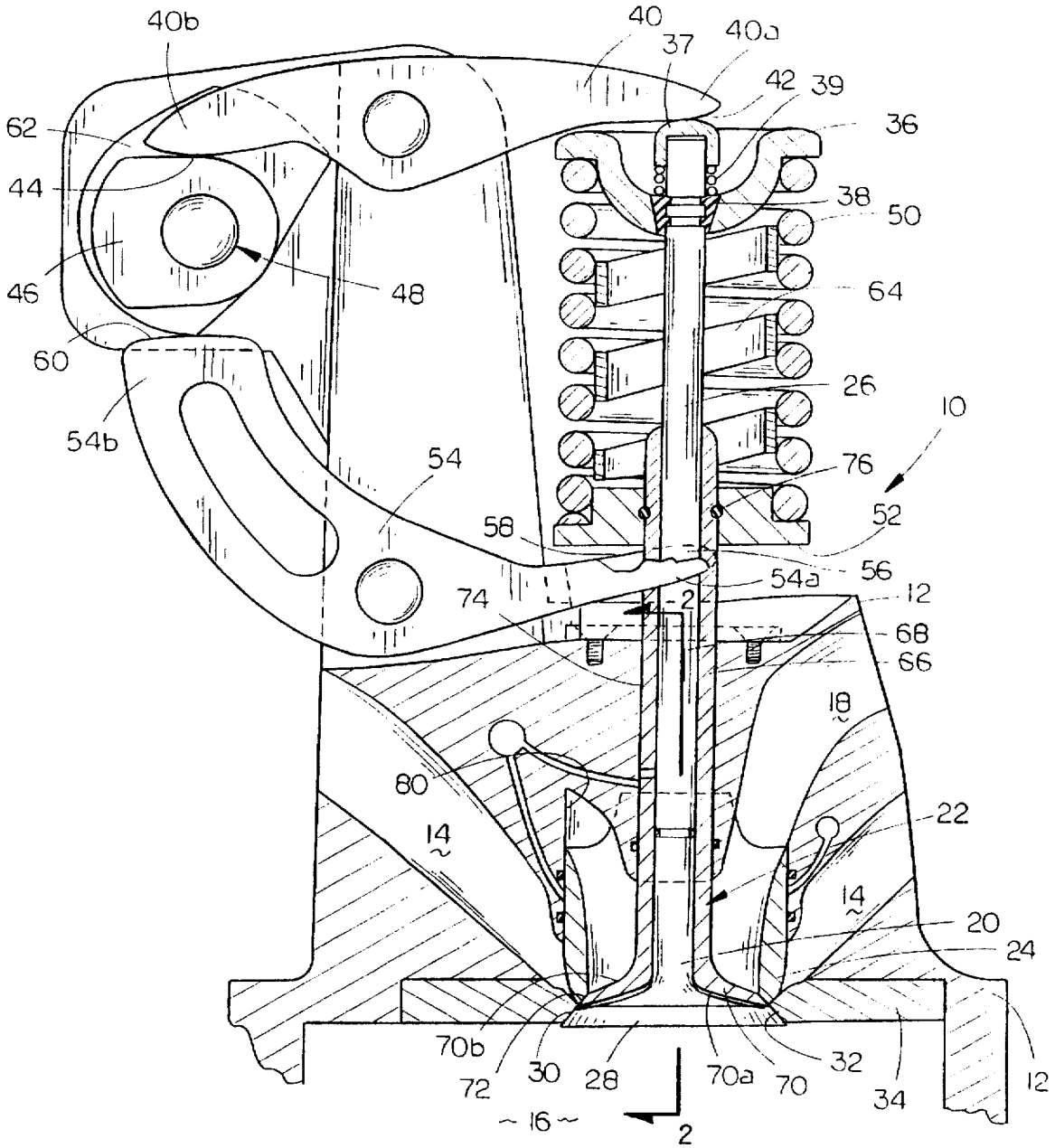
FIG. 1 is a side elevational view in section of the valve of the present invention in the closed position, and with the associated spring controls and rocker arms for operating the valve.

Referring now to the drawings, in which similar or corresponding parts are identified with the same reference numeral and more particularly to FIG. 1, the valve assembly of the present invention is designated generally at 10 and is shown mounted in the bore of a cylinder block 12 of an internal combustion engine. Cylinder block 12 includes air inlet passages 14 formed therein and a combustion chamber 16, with valve assembly 10 periodically closing the passage of air from passages 14 to chamber 16. Cylinder block 12 also includes air exhaust passage 18, which is also selectively closed from communication with combustion chamber 16 by valve assembly 10. As is conventional in internal combustion engines, a piston is disposed in combustion chamber 16, along with an ignition source, neither of which is shown in the drawings.

Valve assembly 10 includes three separate concentrically mounted components, including a main valve 20, an auxiliary valve 22, and a cylindrical valve 24. All three valve components 20, 22, and 24 are operably associated with one another, as will be disclosed in more detail hereinbelow.

Main valve 20 includes an elongated stem 26 and a main valve head 28. Head 28 is a solid disk-shaped member with a beveled edge 30 which will seal against a correspondingly beveled valve seat 32 formed in a valve seat insert 34 mounted in block 12 at the upper end of combustion chamber 16.

The upper end of main valve stem 26 is operably connected to an upper spring retainer plate 36 by a spring retainer key 38, in a conventional fashion, such that longitudinal movement of stem 26 will move spring retainer plate 36 vertically with the stem. A cap 37 may be slidably mounted on the upper end of stem 26, with a spring 39 biasing the cap upwardly into constant engagement with rocker arm 40.

Upper rocker arm 40 is pivotally connected to block 12 generally centrally between forward and rearward ends **40*a* and 40*b* respectively. Forward end 40a has a lower bearing surface 42 in contact with the cap 37 on the upper end of main valve stem 26. Upper rocker arm rearward end 40*b* has a lower bearing surface 44 in contact with a first cam 46 on a rotatable cam shaft 48. Thus, rotation of cam shaft 48 will cause radially projecting surfaces of cam 46 to force rearward end 40*b* of upper rocker arm 40 upwardly, thereby pivoting rocker arm forward end 40*a* downwardly, and thereby forcing valve stem 26 longitudinally downwardly. A coil spring 50 is interposed between the upper spring retainer plate 36, and a lower spring retainer plate 52, and will bias upper spring retainer plate 36 upwardly (and thus rocker arm forward end 40***a*) after being compressed by the downward pivotal movement of rocker end forward end 40*a*.

A second rocker arm 54 is pivotally connected to lock 12 below upper rocker arm 40, and includes forward and rearward ends 54*a* and 54*b* respectively. Forward end 54*a* has a notch 56 formed therein through which valve stem 26 will freely pass. Thus, lower rocker arm forward end 54*a* includes a pair of legs which straddle stem 26, and have an upper bearing surface 58 which will contact the underside of lower spring retainer plate 52. Lower rocker arm rearward end 54*b* includes an upper bearing surface 60 in contact with a second cam 62 on cam shaft 48. Thus, rotation of cam shaft 48 will cause radially extending projections on second cam 62 to pivot lower rocker arm rearward end 54*b* downwardly, and lower rocker arm forward end 54*a* upwardly against the biasing force of retainer spring 50. A helical spring dampener 64 is mounted between upper and lower spring retainer plates 36 and 52, within the confines of coil spring 50, to provide additional dampening force as required.

Auxiliary valve 22 includes a stem portion 66 with a longitudinal bore 68, and a head 70. Bore 68 extends through both stem 66 and head 70, and receives the stem 26 of main valve 20 slidably therein. Auxiliary valve head 70 is dome shaped, with the concave side 70*a* configured to match and nest with main valve head 28. The convex side 70*b* of auxiliary valve head 70 includes a peripheral surface which defines a valve seat 72 for cylindrical valve 24, as discussed in more detail hereinbelow.

Auxiliary valve stem 66 is journaled through a cylindrical guide passage 74 in block 12 for longitudinal reciprocating movement therein. The upper end of auxiliary valve stem 66 is connected to lower spring retainer plate 52 by a key or clip 76 for reciprocating movement therewith. In this way, it can be seen that lower rocker arm 54 will raise lower plate 52 upwardly, and auxiliary valve 22 therewith, while spring 50 will force lower retainer plate 52 downwardly and thereby move auxiliary valve 22 downwardly therewith (as lower rocker arm 54 is pivoted to permit this downward movement).

Figure 2:
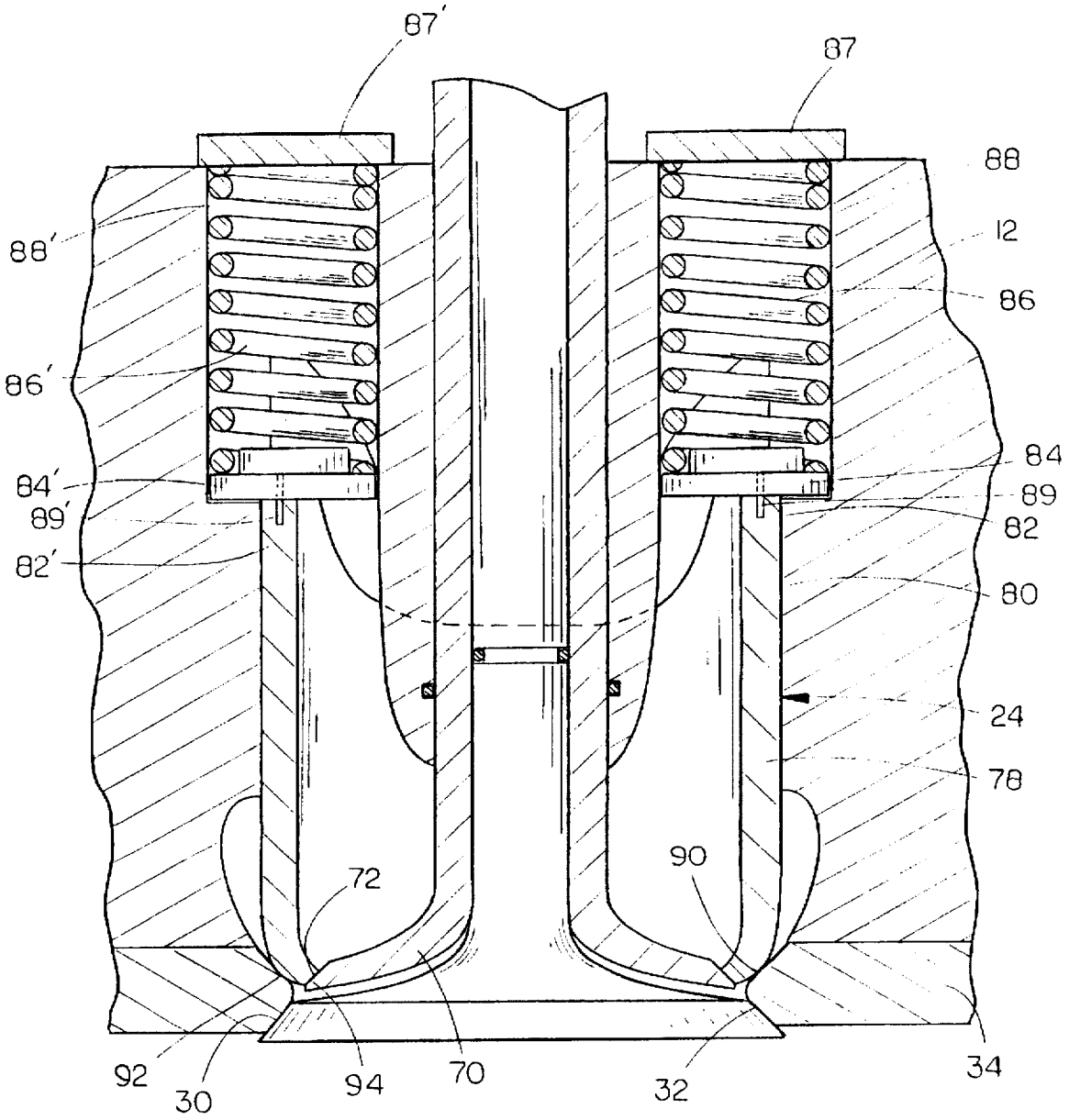
FIG. 2 is a sectional view taken at lines 2—2 in FIG. 1.

Referring now to FIG. 2, cylindrical valve 24 includes a hollow generally cylindrical body 78 mounted for reciprocating movement in a cylindrical bore 80 in block 12, concentric with main valve 20 and auxiliary valve 22. As shown in FIG. 1, bore 80 has an upper end which communicates with exhaust passage 18, and a lower end which communicates with inlet passages 14. The reciprocating movement of cylindrical valve 24 selectively opening and closing the air inlet passages 14.

Diametric sides of valve body 78 have upwardly projecting tab portions 82 and 82' in contact with plates 84 and 84' respectively. Plates 84 and 84' retain the lower end of coil springs 86 and 86' within spring chambers 88 and 88' respectively formed in block 12. Lids 87 and 87' cover spring chambers 88 and 88', to permit insertion and removal of springs 86 and 86'. Pins 89 and 89' connect plates 84 and 84' to valve body 78, to prevent rotation of the valve body within bore 80. Springs 86 and 86' will provide a biasing force against upward movement of cylindrical valve 24, as tabs 82 and 82' move upwardly and compress springs 86 and 86'.

As discussed above, insert 34 has a downwardly directed beveled surface forming a valve seat 32 for main valve head 28. In addition, insert 34 includes an upwardly directed annular beveled surface forming an upper valve seat 90. Upper valve seat 90 on insert 34 forms a seat for the lower end of cylindrical valve 24, to prevent downward movement of cylindrical valve 24 beyond insert 34. As shown in FIG. 2, the lower annular end of cylindrical valve body 78 includes an annular outwardly directed beveled surface 92 and an annular inwardly directed beveled surface 94. Outward surface 92 is configured for sealed contact with upper valve seat 90, while inward surface 94 is configured for sealed contact against valve seat 72 on auxiliary valve head 70. In this way, movement of auxiliary valve head 70 upwardly will raise cylindrical valve 24 upwardly therewith, as inward surface 94 bears on valve seat 72. On the other hand, as auxiliary valve head 70 is moved downwardly, outward surface 92 will contact upper valve seat 90 to prevent movement downwardly beyond valve insert 34.

Figure 3:
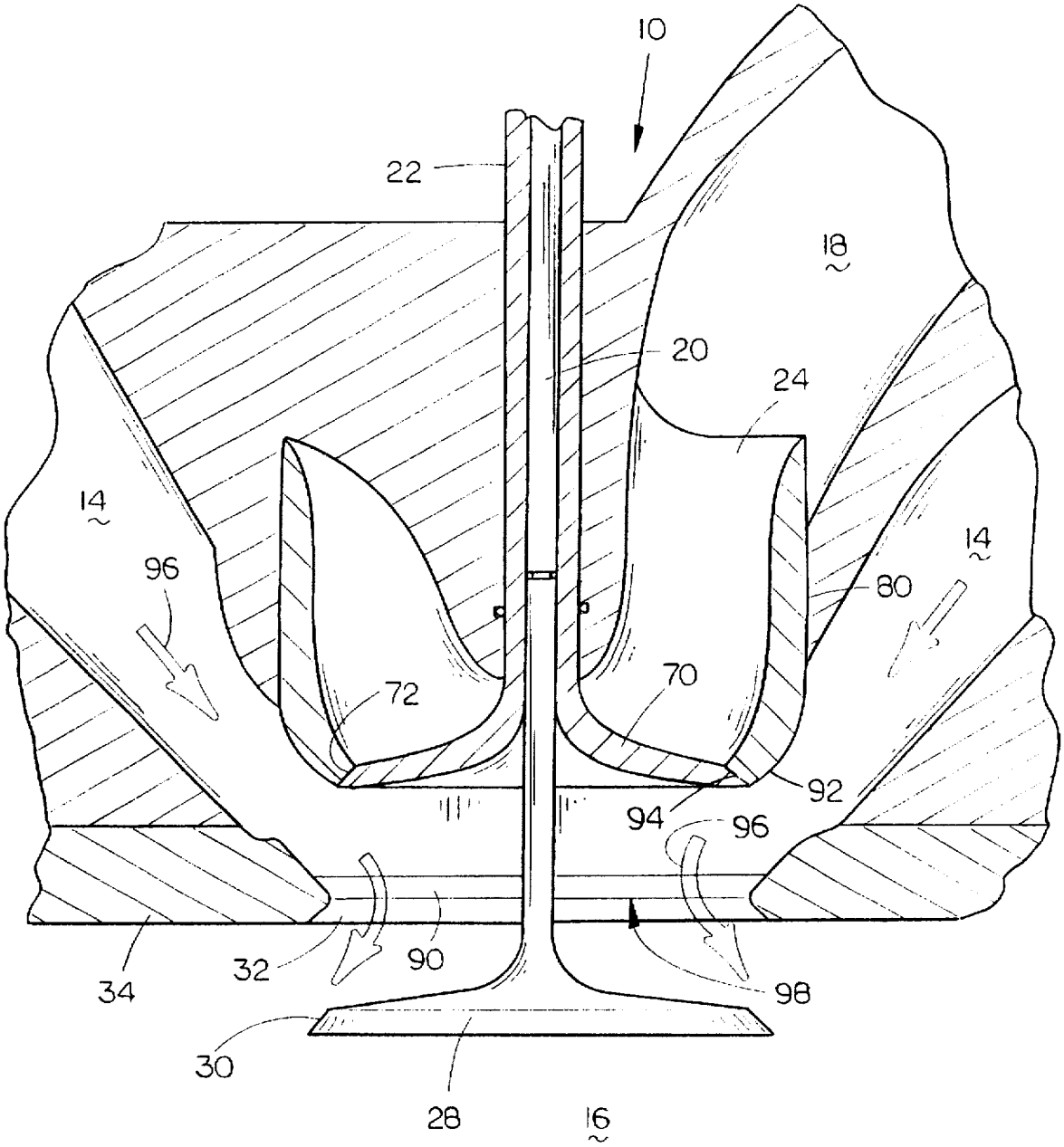
FIG. 3 is an enlarged side elevational view in section of the valve of FIG. 1, shown in the air intake position.

Referring now to FIG. 3, valve assembly 10 is shown in the intake position, wherein air (mixed with atomized fuel) will pass from air inlet passages 14, as shown by arrows 96, through port 98 and into combustion chamber 16. This is accomplished by raising auxiliary valve 22 such that valve seat 72 on auxiliary valve head 70 contacts inward surface 94 of cylindrical valve 24 to thereby close the lower end of cylindrical valve 24 while simultaneously raising valve 24 upwardly within bore 80. This upward movement of cylindrical valve 24 raises cylindrical valve outward surface 92 out of engagement with upper valve seat 90 of insert 34 to permit the flow of air from inlet passages 14 to port 98. Main valve head 28 will already be in the lowered position at the end of the exhaust cycle, with beveled edge 30 out of engagement with lower valve seat 32 to permit the passage of air from port 98 into chamber 16.

Once a sufficient amount of air (and fuel) has entered combustion chamber 16, main valve 20 is raised such that main valve head 28 closes port 98 as shown in Figure 1. This is the compression or combustion position, wherein the fuel within the combustion chamber 16 is ignited to drive a piston.

Figure 4:
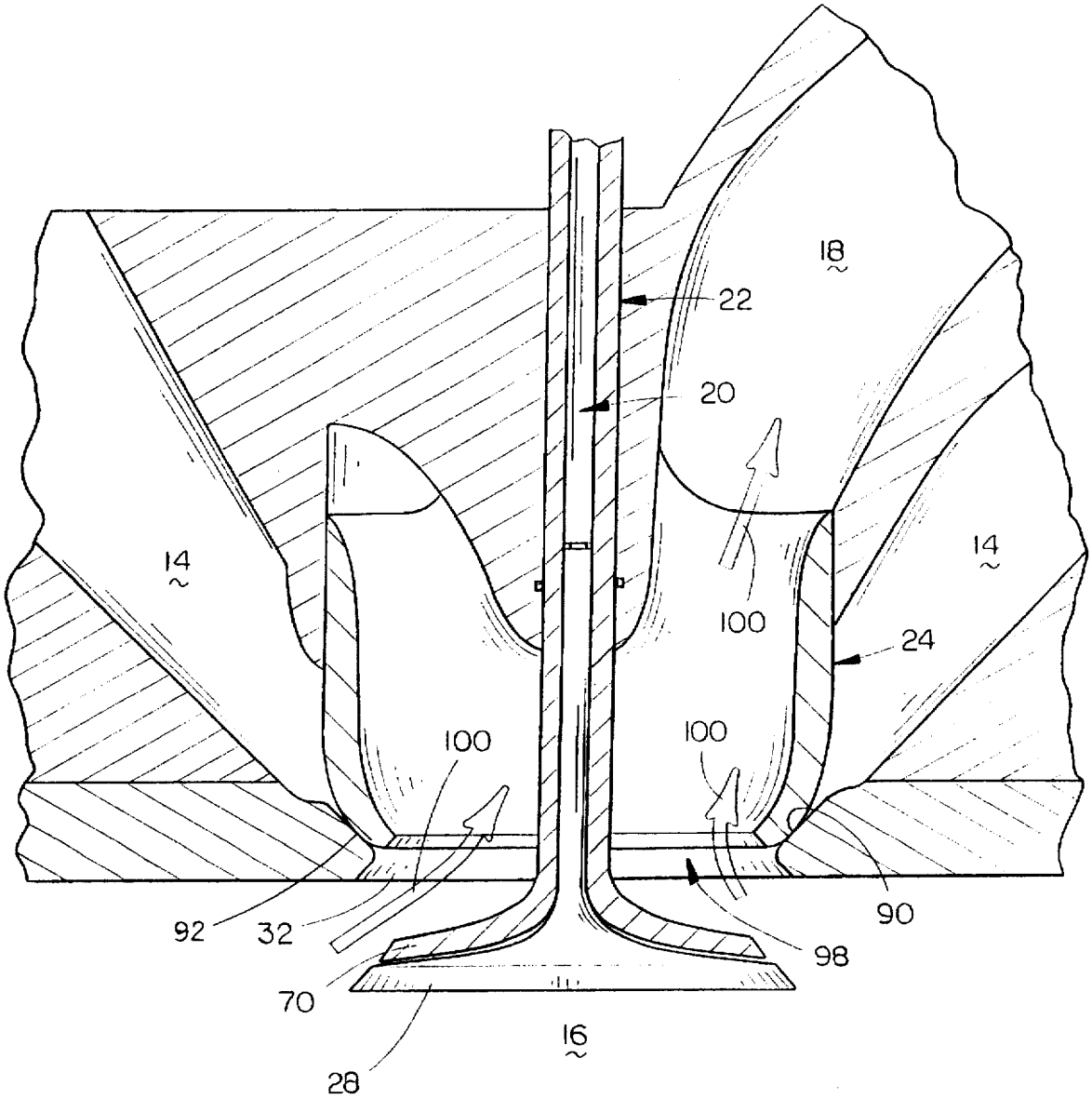
FIG. 4 is a side elevational view and section of the valve of FIG. 1 in the air exhaust position.

Referring now to FIG. 4, the next step in the process will exhaust the combustion chamber 16. To accomplish this, auxiliary valve is first lowered, such that cylindrical valve 24 is biased downwardly to seat the cylindrical valve outward surface 92 in contact with valve seat 90. Both main valve 20 and auxiliary valve 22 are lowered, thereby shifting main valve head 28 downwardly out of engagement with seat 32. Similarly, auxiliary valve head 70 is moved downwardly to thereby open port 98. Because auxiliary valve head 70 is moved downwardly beyond port 98, cylindrical valve 24 is biased downwardly (by springs 86 and 86', shown in FIG. 2) into seated engagement with upper valve seat 90. Thus, cylindrical valve 24 closes the air inlet passages 14 and forms a fluid communication path from combustion chamber 16 to exhaust passage 18, with air being exhausted as indicated by arrows 100. Upon completion of the exhaust cycle, the entire intake, compression, exhaust, cycle is repeated.

Whereas the invention has been shown and described in connection with the preferred embodiment thereof, many modifications, substitutions and additions may be made which are within the intended broad scope of the appended claims. For example, the use of a single spring 50 to provide the return biasing force on both of upper and lower rocker arms 40 and 54, could be replaced with two independently acting springs. Similarly, while coil springs are shown for the biasing force on the valves, other types of biasing apparatus including springs, hydraulic or pneumatic cylinders, additional levers, or other equivalent members, could be substituted therefore.

I claim:

1. A valve assembly, comprising:

a block having a chamber formed therein and a port for accessing the chamber;

a fluid inlet passage formed through said block and communicating with said port;

a fluid exhaust passage separate from the inlet passage and communicating with said port;

said port having a portion defining a lower valve seat and a portion defining an upper valve seat;

a main valve having a head movable into and out of engagement with the lower valve seat to respectively close and open said port;

an auxiliary valve having a head disposed for movement through said port between a first position disposed below the port and permitting fluid flow therethrough, and a second position disposed above the port and permitting fluid flow therethrough;

said auxiliary valve head including a portion defining a third valve seat;

a hollow cylindrical valve having a generally vertically oriented cylindrical wall with upper and lower ends, disposed for movement into and out of engagement with the upper valve seat to respectively close and open the inlet passage's communication with the port;

said cylindrical valve hollow passage being in communication with the exhaust passage throughout its movement;

said auxiliary valve head disposed for movement of the third valve seat into and out of engagement with the cylindrical valve lower end, to respectively close and open the hollow passage through the cylindrical valve; and means for sequentially moving said main valve head out of engagement with the lower valve seat, moving said auxiliary valve upwardly to the second position and moving said cylindrical valve out of engagement with the upper valve seat, to define an intake position to permit the flow of fluid from the inlet passage, through the port, to the chamber.

2. The valve assembly of claim 1, wherein said means for sequentially moving the valves includes means for sequentially moving the valves to a closed position, with the main valve in engagement with the lower valve seat, to prevent fluid flow through the port.

3. The valve assembly of claim 2, wherein said means for sequentially moving the valves includes means for sequentially moving the valves to an exhaust position with the main valve out of engagement with the lower valve seat, the auxiliary valve in the first position with the third valve seat out of engagement with the cylindrical valve, and the cylindrical valve in engagement with the upper valve seat, to permit fluid flow from the chamber, through the port, and through the exhaust passage.

4. The valve assembly of claim 3, wherein said means for sequentially moving the valves to the closed position includes means for moving the auxiliary valve seat into engagement with the cylindrical valve and for moving the cylindrical valve into engagement with the upper valve seat.

5. The valve assembly of claim 4, wherein said auxiliary valve includes a stem connected to the auxiliary valve head and mounted for reciprocating movement in said port, said auxiliary valve stem having a longitudinal bore therethrough, and said main valve including a stem connected to the main valve head and mounted for reciprocating movement in said auxiliary valve stem bore.

6. The valve assembly of claim 5, wherein said cylindrical valve is mounted for reciprocating movement in a cylindrical bore formed in said block, said cylindrical valve mounted concentric with the main valve stem and the auxiliary valve stem.

7. The valve assembly of claim 6, wherein said cylindrical valve is spring biased to normally hold the cylindrical valve in engagement with the upper valve seat.

8. The valve assembly of claim 7, wherein said main valve is spring biased to normally hold the main valve head in engagement with the lower valve seat.

9. The valve assembly of claim 8, wherein the auxiliary valve is spring biased to normally hold the auxiliary valve head in the first position.

10. The valve assembly of claim 1, wherein said auxiliary valve includes a stem connected to the auxiliary valve head and mounted for reciprocating movement in said port, said auxiliary valve stem having a longitudinal bore therethrough, and said main valve including a stem connected to the main valve head and mounted for reciprocating movement in said auxiliary valve stem bore.

11. The valve assembly of claim 10, wherein said cylindrical valve is mounted for reciprocating movement in a cylindrical bore formed in said block, said cylindrical valve mounted concentric with the main valve stem and the auxiliary valve stem.

12. The valve assembly of claim 11, wherein said cylindrical valve is spring biased to normally hold the cylindrical valve in engagement with the upper valve seat.

13. The valve assembly of claim 12, wherein said main valve is spring biased to normally hold the main valve head in engagement with the lower valve seat.

14. The valve assembly of claim 13, wherein the auxiliary valve is spring biased to normally hold the auxiliary valve head in the first position.

15. The valve assembly of claim 1, wherein said cylindrical valve is spring biased to normally hold the cylindrical valve in engagement with the upper valve seat.

16. The valve assembly of claim 15, wherein said main valve is spring biased to normally hold the main valve head in engagement with the lower valve seat.

17. The valve assembly of claim 16, wherein the auxiliary valve is spring biased to normally hold the auxiliary valve head in the first position.

* * * * *